US006568186B2

(12) United States Patent
Zaleski

(10) Patent No.: US 6,568,186 B2
(45) Date of Patent: May 27, 2003

(54) HYBRID EXPANSIBLE CHAMBER ENGINE WITH INTERNAL COMBUSTION AND PNEUMATIC MODES

(75) Inventor: Bogdan J. Zaleski, Columbus, OH (US)

(73) Assignee: Nano Precision, Inc., Columbus, OH (US)

( * ) Notice: Subject to any disclaimer, the term of this patent is extended or adjusted under 35 U.S.C. 154(b) by 0 days.

(21) Appl. No.: 09/886,638

(22) Filed: Jun. 21, 2001

(65) Prior Publication Data

US 2002/0194850 A1 Dec. 26, 2002

(51) Int. Cl.[7] ..... F01B 21/04
(52) U.S. Cl. ..... 60/698; 60/706; 60/39.6
(58) Field of Search ..... 60/698, 706, 712, 60/39.6; 123/527; 477/186, 187

(56) References Cited

U.S. PATENT DOCUMENTS 2,146,265 A * 2/1939 Moore, Jr.
3,148,668 A 9/1964 Bianchi
3,446,013 A 5/1969 Wall
3,765,180 A 10/1973 Brown
4,230,075 A 10/1980 Lowther
4,290,268 A 9/1981 Lowther
4,300,486 A 11/1981 Lowther
4,372,414 A 2/1983 Anderson et al.
5,088,041 A 2/1992 Tanaka et al.
5,495,912 A 3/1996 Gray, Jr. et al.
5,529,549 A * 6/1996 Moyer ..... 477/189
5,549,174 A 8/1996 Reis
5,695,430 A * 12/1997 Moyer ..... 477/189
6,223,846 B1 * 5/2001 Schechter ..... 180/165

* cited by examiner

*Primary Examiner*—Hoang Nguyen
(74) *Attorney, Agent, or Firm*—Frank H. Foster; Kremblas, Foster, Phillips & Pollick

(57) ABSTRACT

A hybrid engine, having a plurality of coupled expansible chamber devices, preferably a piston in a cylinder, each capable of operating in any one of an internal combustion mode, an air pump/compressor mode and an air motor mode. The modes are controlled by a microcontroller which controls the valves, ignition source and fuel source. The mode for each expansible chamber device is computed and independently selected by the microcontroller and the combination of modes at any instant is switched to optimize engine operation for the operating conditions at that instant.

7 Claims, 6 Drawing Sheets

HYBRID EXPANSIBLE CHAMBER ENGINE WITH INTERNAL COMBUSTION AND PNEUMATIC MODES

(e) BACKGROUND OF THE INVENTION

1. Field of the Invention

This invention relates generally to engines for powering machines, especially land vehicles, and more particularly relates to an expansible chamber engine in which each of the chambers is capable of operating in a plurality of different modes, specifically in internal combustion and pneumatic modes.

2. Description of the Related Art

Over the past century, the efforts of many inventors and designers have led to substantial improvements in engines for supplying mechanical power for propelling vehicles, operating industrial machinery and driving other mechanical devices. Although high performance and power were initially of primary interest, in more recent years there has been more emphasis upon improving efficiency in order to gain energy savings and lower pollutant emission for environmental protection purposes.

These more recent design goals typically require that engineering trade-offs must be made in engine design between (1) an engine which exhibits a high fuel efficiency and low pollutant emission; and (2) an engine which is capable of providing high performance and sufficiently high power to meet the power demands of loading under particular conditions, such as high acceleration. Engines for vehicles typically require high performance or power during only a very small proportion of their time of operation and the remainder of the time the engine can exhibit high fuel efficiency and low pollutant emission characteristics. A designer attempts to minimize weight and pollution emission, while maximizing fuel economy, performance and power. Although engines can be designed for very high fuel efficiency and low emission and engines can be designed for high performance and power, once an engine is constructed, the range of variations in these characteristics becomes substantially limited.

One proposed solution, which has recently seen some initial introduction into the commercial market, is the hybrid engine, which couples an internal combustion engine with an electric motor. This type of hybrid engine is capable of changing its mode of operation so that motive power is supplied by the internal combustion engine component or the electric motor component, or both. The electric motor component is designed to also operate as a generator or alternator when driven by the internal combustion engine or during braking.

Although such hybrid IC-electric engines show substantial advantages and promise, they also suffer substantial disadvantages. Electrically powered vehicles require batteries which add substantial weight to a vehicle, thereby reducing fuel efficiency. Additionally, efficiency and fuel economy are deterred by the inefficiency of the process of converting energy from one form to another combined with the need for many such conversions with this type of hybrid engine. The IC and electric hybrid engine requires the chemical energy of the fuel to be converted to heat by combustion, the heat to be converted to mechanical energy by expansion, the mechanical energy to be converted to electrical energy by the generator or alternator and the electrical energy to be converted to chemical energy which is stored in the battery. Then, use of this energy requires that the chemical energy of the battery be converted to electrical energy and the electrical energy be converted in the electric motor to mechanical energy. Each energy conversion step has substantial energy loss and inefficiency inherent in the energy conversion processes.

There have been a variety of systems proposed for recovering energy from the braking of the vehicle. In the hybrid IC-electric engine, the recovery of braking energy is limited by the current capacity of the motor/alternator/generator and also by the battery's maximum charging rate.

Other inventors have proposed the storage of energy by the use of expansible chamber devices, such as a piston in a cylinder, operated as an air compressor for compressing air into a storage tank. The prior art has also taught the use of compressed air applied to an air motor for a power assist purpose. The prior art teaches the recovery of braking energy by use of an air compressor and the storage of the recovered energy in the form of compressed air. The prior art teaches driving a compressor with an internal combustion engine and the storage of the compressed air. The prior art additionally teaches the use of the compressed air to support combustion in an internal combustion engine.

U.S. patents relevant to this prior art are U.S. Pat. Nos. 4,230,075; 4,290,268; 4,300,486; 3,148,668; 5,549,174; and 3,765,180.

So far as is known, these engine concepts have not received significant commercial research and development, possibly because they, like the hybrid IC and electric engine, require the coupling of at least two separately identifiable engines which introduce the complications of coordinating and controlling their operation.

It is therefore an object and feature of the present invention to improve energy efficiency by reducing the number of conversions of energy from one form to another in order to improve fuel economy.

Another object and feature of the invention is to provide an engine in which the entire engine may be used for all operating conditions, but is capable of optimizing its mode of operation for each operating condition.

Another object and feature of the invention is to minimize engine weight by avoiding the need for batteries and by avoiding the use of multiple, different types of engines or motors coupled together.

Another object and feature of the invention is to improve braking energy recovery by storing all power as mechanical energy in the form of compressed air and using the entire engine for the braking energy recovery, thereby avoiding the electrical current and battery charging rate limitations of electrical systems.

Another object and feature of the invention is to provide a broader range of flexibility in engine characteristics and to minimize the need to sacrifice desirable characteristics as a part of design engineering trade-offs without significantly increased cost of production.

(f) BRIEF SUMMARY OF THE INVENTION

The invention is a hybrid expansible chamber engine, such as a piston and cylinder structure, having a plurality of expansible chamber devices coupled together. Each expansible chamber device is capable of operating in an internal combustion mode, an air motor mode and an air compressor mode. Consequently, the mode for each expansible chamber device can be switched among the available modes to accommodate current operating conditions, as those operating conditions change. This engine operates with known supporting devices such as an air storage tank for compressed air, a fuel source, such as fuel injection, valves and an ignition source. A control system receives input signals, for example representing engine speed, accelerator position and brake pedal position, and from those signals computes and selects the mode of operation for each expansible chamber device so that, at any instant of time, different expansible chamber devices are operating in appropriate modes, which may be different or the same. The combination of modes is changed to most effectively meet presently existing operating conditions as those operating conditions change.

(g) BRIEF DESCRIPTION OF THE SEVERAL VIEWS OF THE DRAWINGS

Figure 1:
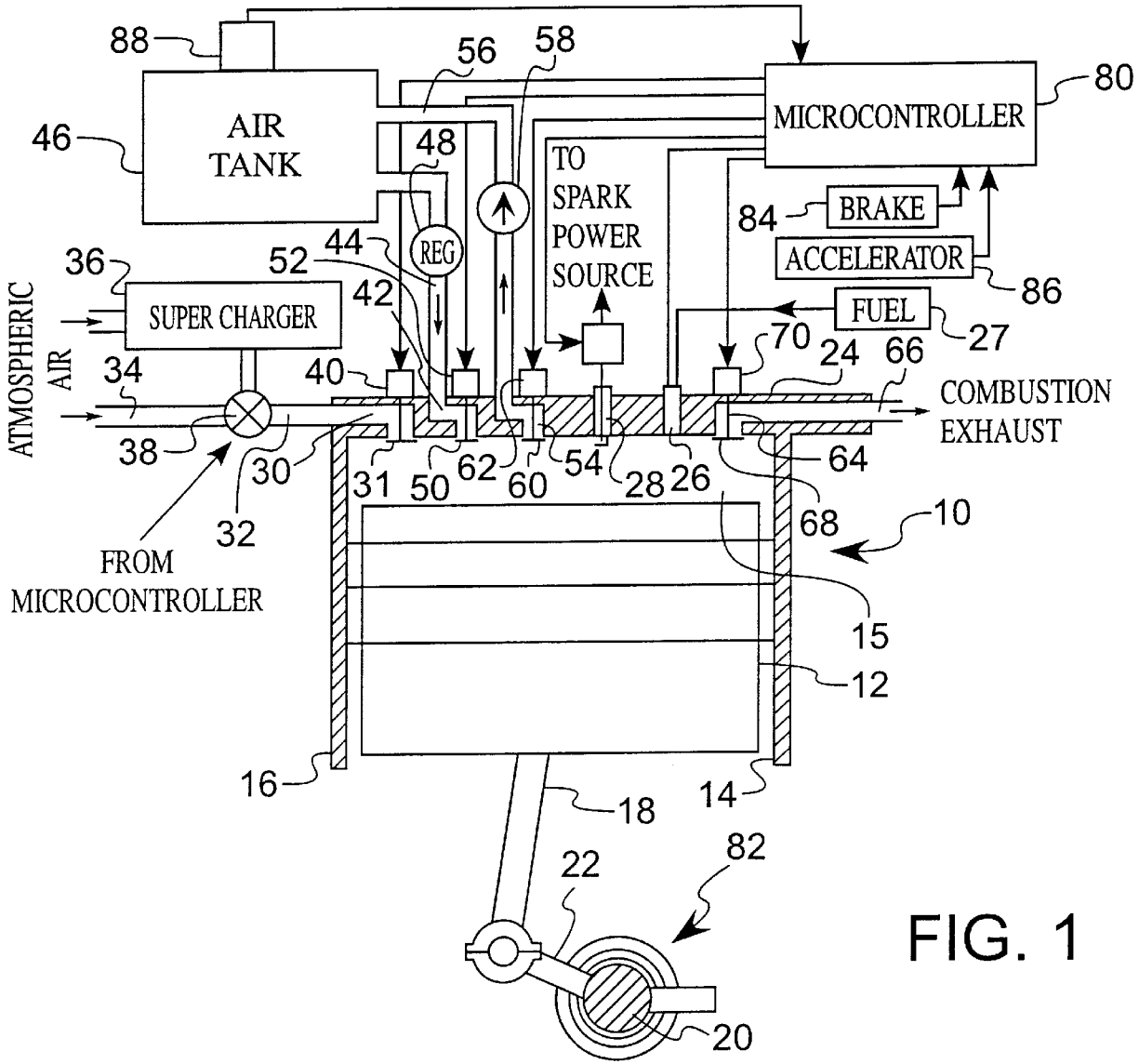
FIG. 1 is a diagrammatic view of a single cylinder and piston embodying the present invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the words "connected", "linked", or terms similar thereto, are often used. They are not limited to direct connection, but include connection through other elements where such connection is recognized as being equivalent by those skilled in the art.

(h) DETAILED DESCRIPTION OF THE INVENTION

FIG. 1 illustrates an expansible chamber device 10 formed by a piston 12, which is sealingly slidable within a cylinder 14 formed in a housing 16. The piston is linked by a connecting rod 18 to a crankshaft 20, including a crank throw 22 to which the piston connecting rod 18 is connected. Formed or attached in the head 24 are a plurality of passages, ports and valves, together with a fuel port 26, such as a conventional fuel injector connected to a fuel source 27, and an ignition source 28, such as a conventional spark plug connected to an electrical power source.

Although a conventional piston and cylinder device is preferred, other expansible chamber devices may be used. Examples of expansible chamber devices are illustrated in the art collected in Class 92 of the classification system in the United States Patent and Trademark Office. Typically, an expansible chamber device has a fixed part and a movable part which define a chamber between them. These parts are sealingly joined so that, when the movable part is moved, the volume of the chamber is varied, but no significant gas can escape, except as permitted under the control of valves. As will be seen from the following description of the invention, in addition to the well-known piston-cylinder expansible chamber device, the principles of the present invention may also be applied to other expansible chamber devices, including free piston linear motors and rotary expansible chamber devices.

Additionally, the terms "intake", "inlet", and "outlet" are used in this description to describe some of the ports, passages and chambers. These directional terms are used with reference to the expansible chamber. Thus, for example, an air tank outlet port is a port through which air travels out from the expansible chamber into the air tank.

As is commonly known to those skilled in the art, expansible chamber engines typically consist of multiple expansible chamber devices which are coupled together, such as by connection to multiple throws on a crankshaft. Typically, the throws, and therefore the operation of the expansible chamber devices, are equi-angularly phased around each crankshaft cycle. The same is contemplated in connection with the present invention. Therefore, most of the drawings illustrate a single expansible chamber device, but, as taught in the prior art, multiple ones of these are coupled together. Although the current preferred embodiment has four such expansible chamber devices of the piston-cylinder type, it is readily apparent that more or fewer such devices may be coupled together, as is known in the prior art.

Referring again to FIG. 1, the head 24 of the expansible chamber device 10 includes an atmospheric air intake port 30, connected through an atmospheric air intake passage 32 to a source of atmospheric air, such as the ambient atmosphere. Preferably, the atmospheric air intake passage 32 includes a passage 34 leading directly from the atmosphere to the atmospheric air intake passage 32 and also includes a supercharger 36, of conventional design, connected between the atmosphere and the atmospheric air intake port 30. One of these two parallel sources of atmospheric air, one supercharging the air to an increased pressure, is selected by a suitable valve, such as a Y valve 38, so that air flow into the cylinder 14 is alternatively either from the supercharger 36 or through the passage 34, directly from the atmosphere. The Y valve is controlled by and connected to an output of the control system/microcontroller, described below.

A controllable valve 31 is located at the atmospheric air intake port 30 for controlling the flow of gas through the port 30. Although the valve 31, like the other valves yet to be described, can be controlled by any of the known prior art type of controls, such as mechanical, hydraulic and electrical control systems, it is preferable to use a solenoid type of valve actuator 40. Valves of the preferred type are known to those skilled in the art and are illustrated in U.S. Pat. Nos. 5,598,814 and 6,065,668, which are herein incorporated by reference. Such valves have also been commercially manufactured by companies, such as Bosch and International Harvester.

The expansible chamber device 10 further includes an air tank inlet port 42 connected through an air tank inlet passage 44 to an air tank 46. Preferably, an air regulator 48 is interposed within the air tank inlet passage 44, so that pressurized air may be supplied from the air tank 46 into the expansible chamber 15 of the cylinder 14 at a desired pressure. A valve 50 is located at the air tank inlet port 42 for controlling the flow of air into the cylinder chamber 15. The valve 50 is controlled by a valve actuator 52.

The expansible chamber device 10 further includes an air tank outlet port 54 connected through an air tank outlet passage 56 to the air tank 46. Its purpose is to, at times, supply compressed air from the chamber of the cylinder 14 into the air tank 46. Therefore it is preferably provided with a check valve 58. The air tank outlet port 54 is also provided with a valve 60 connected to a valve actuator 62, similar to the previously described valve actuators.

The expansible chamber device 10 is further provided with a combustion gas outlet port 64, connected through a combustion exhaust passage 66 to the atmosphere to permit the escape of exhaust gases resulting from internal combustion. It also permits the escape of air when the expansible chamber device is operated as an air motor. The combustion gas exhaust port 64 is also provided with a controllable valve 68, operated by an electrical valve actuator 70, similar to those previously described.

All of the valve actuators are preferably connected to outputs from a microcontroller 80. A microcontroller of the type used in the present invention is well known in the art and is essentially a small special purpose computer, which has been programmed to operate in accordance with the operating principles described below. The microcontroller receives several input signals for use in controlling the opening and closing of the valves 31, 50, 60 and 68, as well as for control of the spark source 28 and the fuel inlet port 26.

Although a variety of structures are known for converting the linear, reciprocating motion of a piston to rotary motion, a crankshaft, such as the crankshaft 20, is preferred as the mechanical power output of the present invention. A position sensor, preferably an synchro resolver 82, is physically connected to the crankshaft 20, which, in the manner well known to those skilled in the art, provides an input signal to the microcontroller 80, representing the instantaneous, angular position of the crankshaft 20.

A brake pedal position sensor 84 is mechanically connected to the vehicle brake and electrically connected to an input of the microcontroller 80. This pedal position sensor 84 signals when the brake pedal has been depressed as a result of the vehicle operator initiating a deceleration activity. Preferably the pedal position sensor 84 provides more complex signal containing data representing the force being applied by the vehicle operator in order for the control system to determine the rate of deceleration which the operator is attempting to accomplish. Such position and force sensors are known to those skilled in the art and therefore are not described further.

An accelerator pedal position sensor 86 is mechanically connected to the vehicle accelerator pedal and electrically connected to an input of the microcontroller 80 control system. The accelerator pedal position sensor detects the displacement or position of the accelerator pedal in order for the control system to determine the rate of acceleration sought by the vehicle operator.

An air pressure sensor 88 is mechanically connected to the air tank 46 and provides an output signal, which is input to the microcontroller 80 for providing data representing the air pressure in the air tank 46.

The presence of the fuel and spark sources, along with the inlet and outlet ports having valves controlled by the microcontroller 80 control system, permits the expansible chamber device 10 to be operated in any one of a multiplicity of different modes. The control system independently operates each of the expansible chamber devices in any of these modes without regard to the operating mode of the other expansible chamber devices. It does so by independently controlling the valves, ignition and fuel for each expansible chamber device in the manner appropriate to the selected mode.

The expansible chamber device 10 may be operated in an air pump/compressor mode by opening and closing only the atmospheric air intake port 30 and the air tank outlet port 54 while leaving the other ports closed during this operating mode. During the downward intake stroke, the valve 31 at the atmospheric air intake port 30 may be opened to admit or draw air either from the atmosphere through passage 34, or at a supercharged pressure from the supercharger 36. During the upward compression stroke the valve 60 is opened to force air through the air tank outlet port 54, so that air will be compressed and forced into the air tank 46 when the pressure on the upstream side of the check valve 58 exceeds the pressure in the air tank 46. This mode is utilized preferably in all of the coupled expansible chamber devices during a braking operation. The backpressure of the compressed air in the air tank 46 applies a force decelerating the vehicle and the energy recovered from the braking operation is stored in the form of compressed air in the air tank 46. This pump/compressor mode is also used in some of the expansible chamber devices during normal, steady cruising operation in order to maintain a supply of compressed air in the air tank 46, while one or more of the other of the expansible chamber devices is operated in an internal combustion mode to propel the vehicle and operate the expansible chamber devices which are operating in the pump/compressor mode.

The expansible chamber device 10 may also be operated in an air motor mode by operating the controlled valve 50, in the air tank inlet port 42, and the controlled valve 68 in the combustion gas exhaust port 64, while the other valves remain closed. In the air motor mode, the valve 50 is opened at or near the top dead center position of the piston 12, so that air admitted through the air tank inlet passage 44, at the pressure determined by the regulator 48, forces the piston 12 downwardly. The valve 50 is open for a time interval and then closed. That time interval is variable and is selected in accordance with the power demand of the engine, as signaled by the depression of the accelerator. After the piston 12 reaches the bottom of the stroke and the valve 50 has closed, the valve 68 in the combustion exhaust port 64 is opened so that the expanded air is exhausted through the exhaust passage 66. The air motor mode offers the ultimate minimum in pollutant emission. The air motor mode is used for starting the engine, and for operating the engine with minimum emission. For example, all expansible chamber devices may be operated in the air motor mode when operating the vehicle in an enclosed space, such as a garage. For starting the vehicle, the stored, compressed air in the air tank may be used to operate one or multiple ones of the expansible chamber devices in the air motor mode, while others of the expansible chamber devices are operated in the internal combustion mode and started. Of course, an auxiliary electric motor, such as a conventional internal combustion starting motor, may be provided for use either to start the motor in the IC mode or to operate the expansible chamber devices in the air compressor mode to build up a reserve pressure in the tank for use in starting the engine.

Each expansible chamber device 10 is also capable of being operated in the internal combustion engine mode by appropriately operating the control valve 68 in the combustion gas exhaust port 64 and either one or both of the valves 31 and 50 in the atmospheric air intake port 30 and the air tank inlet port 42. Each expansible chamber device may be operated in any of several alternative internal combustion modes which are known to those skilled in the art, including those known as the two cycle mode, the four cycle mode, and Diesel modes. For any of these internal combustion modes of operation, the invention permits optimization of combustion efficiency or power and performance by providing the alternative use of three air intakes. Air may be drawn at atmospheric pressure through the passage 34 into the atmospheric air intake port 30, or alternatively at an increased pressure through the supercharger 36. As a third alternative, air may be supplied into the chamber 15 of cylinder 14 from the air tank 46 by opening the valve 50 in the air tank inlet port 42.

Consequently, by controlling the time interval during which the fuel is injected through the fuel inlet port 26 and controlling the quantity and pressure of air admitted into the chamber of the cylinder 14 through any of the three alternative intakes, the optimum fuel-air mixture may be attained for the existing operating conditions, as determined by engine speed detected by the angular position sensor 82 and the load demand, as determined by the input from the accelerator position sensor 86. The particular mixtures for the variety of instantaneous operating conditions are not described because they have long been the subject of much study and literature of the prior art.

The internal combustion mode is used for the ordinary powering of the vehicle or other equipment which the engine is driving. When maximum power and performance are required, all of the coupled expansible chamber devices may be operated in the IC mode. The two cycle mode is most preferred because it offers the maximum power output. However, the IC modes of those expansible chamber devices which are operating in an IC mode may be switched to the four cycle, or other IC modes, during operation by changing the timing of valve operation.

During normal vehicle cruising, some of the expansible chamber devices are operated in the IC mode, while others are operated in the air compression mode. The purpose is to maintain a supply of pressurized air in the air tank 46, available for supporting the combustion in those expansible chamber devices which are operated in the IC mode. The number of expansible chamber devices operating in each mode may be varied in accordance with operating conditions. For example, when the vehicle operator wishes a low rate of acceleration from a steady cruising speed, some modes are switched so that more, but not all, of the expansible chamber devices are operated in the IC mode, while fewer are operated in the air pump mode. Similarly, when a vehicle is decelerating at a low rate of deceleration, or is travelling downwardly on a hill, more of the expansible chamber devices may be operated in the air pump mode, while fewer are operated in the IC mode. It is desirable to vary the particular expansible chamber devices as used in each mode in order to uniformly distribute ordinary wear among all the expansible chamber devices.

FIG. 2 is a graphical illustration of the operation of each expansible chamber device in several different modes. FIG. 2 has several oscillograms in which timing or phase angle is illustrated on the horizontal axis for each of four modes, while the vertical relationship on the graphs shows the timing of various events relative to the timing of other events. A vertical axis or line through FIGS. 2*a*–2*g* represents simultaneously occurring events.

Figure 2A:
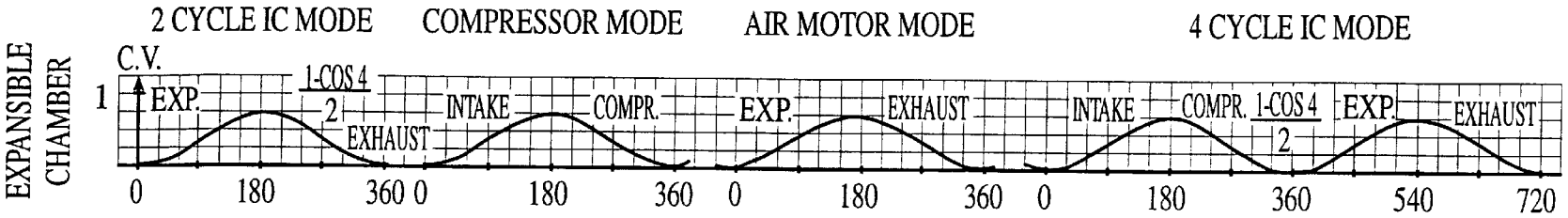
FIGS. 2A–2G are graphs similar to oscillograms illustrating the operation of an embodiment of the invention.

FIG. 2*a* illustrates the expansible chamber volume as a function of piston or crankshaft position. The expansible chamber volume varies in accordance with the function illustrated in the drawing. Top-dead center is referenced as zero degrees of crankshaft rotation, followed by the expansion stroke, during which chamber volume increases, and then the compression stroke, during which chamber volume decreases. The chamber volume is illustrated for each of four modes of operation. FIGS. 2*b*–2*g* illustrate the operation of the valves and the ignition source (FIG. 2*g*) during each representative cycle.

Figure 2B:
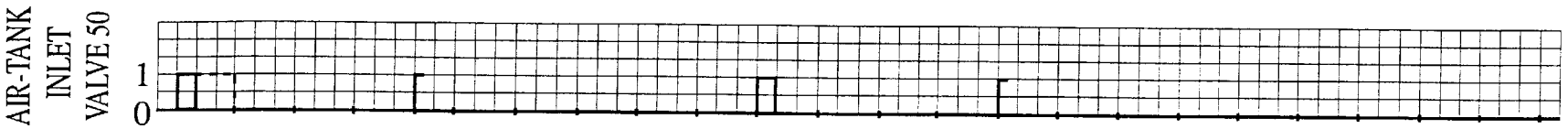
Figure 2C:
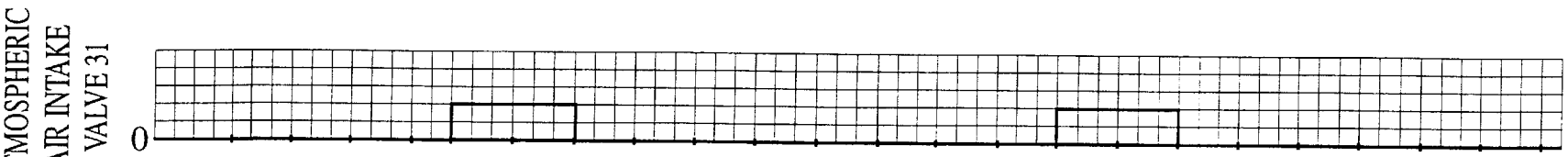
Figure 2D:
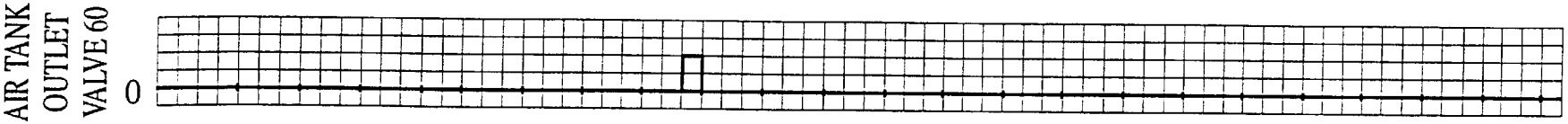
Figure 2E:
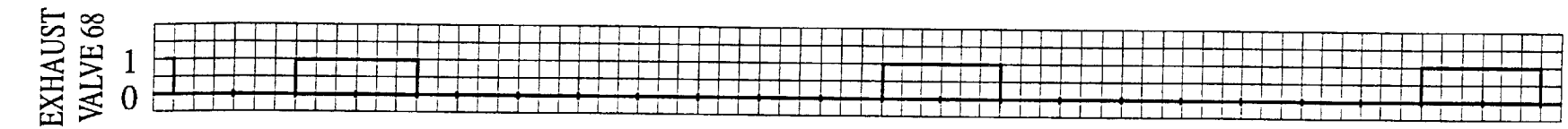

In the two cycle IC mode, because air supply from the air tank 46 is the preferred manner of supplying air for combustion into the chamber, the air tank inlet valve 50 is opened beginning at or near zero degrees and maintained open for a length of time which is an increasing function of the quantity of air desired, as illustrated by the dashed lines in FIG. 2B. Since the preferred air supply is used, the atmospheric air intake valve 31 is illustrated in FIG. 2C as maintained in its closed position. Alternatively, however, the air tank inlet valve 50 could be maintained in its closed position with the air similarly being taken into the chamber by the atmospheric air intake valve 31. During two cycle IC mode operation, the air tank outlet valve 60 is maintained closed, as shown in FIG. 2*d*. The exhaust valve 68 is opened at 180° and closed again at 360° as shown in FIG. 2E.

Figure 2F:
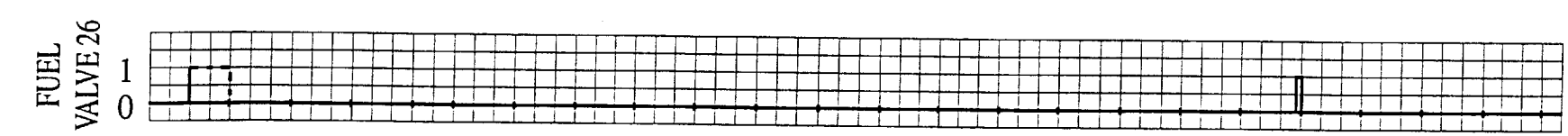

In FIG. 2*f* the dashed lines illustrate that the fuel valve 26 is opened and fuel is injected into the chamber beginning at or shortly after zero degrees and is maintained opened for a length of time proportional to the quantity of fuel desired in the air-fuel mixture, as illustrated by the dashed lines.

Figure 2G:
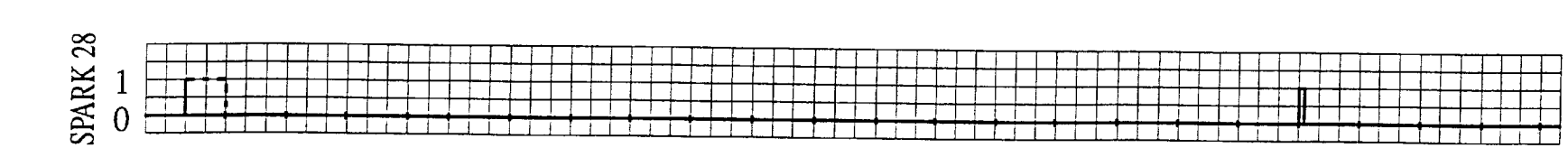

FIG. 2*g* shows that the spark ignition source 28 may be actuated at a selected position after zero degrees and after all fuel and air have been injected into the chamber.

For compressor mode operation, FIG. 2D illustrates opening of the atmospheric air intake valve 31 during the expansion stroke and opening of the air tank outlet valve 60 near the end of the compression stroke. Because a typical supercharger is capable of tripling the atmospheric pressure to approximately 45 psi and a typical IC engine of conventional design has a compression ratio of 10:1, if air is supplied through the supercharger 36 during the compressor mode, the air can be compressed in the chamber 15 to approximately 450 psi. In order to further increase the pressure of compressed air stored in the air tank 46, the compression ratio may be increased by reducing the top dead center clearance between the top of the piston and the bottom of the head, as is known to those skilled in the art. With the substantially reduced clearance, the pressure at which compressed air is released from the chamber is determined by the phase angle during the cycle at which the valve 60 in the air tank outlet port is opened. The later in the cycle it is opened the higher the pressure. Consequently, FIG. 2D illustrates a typical opening interval for the valve 60. Although not preferred, this would allow the check valve 58 to be eliminated. Alternatively, of course, with the check valve, the air tank outlet valve 60 may be opened during the entire compression half cycle.

In the air motor mode, FIG. 2*b* illustrates that the air tank inlet valve 50 may be opened for a time interval beginning at zero degrees and ending any time before 180°. The dashed line of FIG. 2*b* under air motor mode illustrates the variation in the open time interval for the air tank inlet valve 50 in order to accomplish the desired power output from each expansible chamber device operating in the air motor mode. FIG. 2E illustrates the opening of the exhaust valve 68 during the compression/exhaust stroke.

Figure 4:
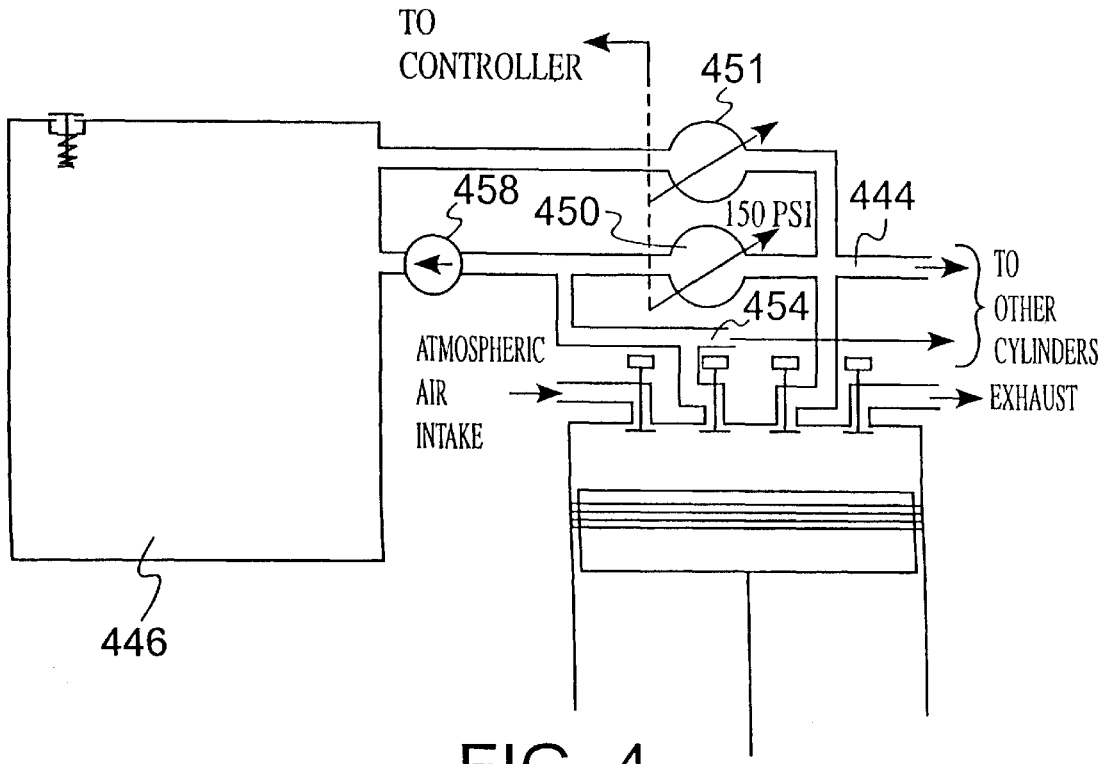
FIG. 4 is a diagrammatic view of an alternative embodiment of the invention.

The operation of the embodiment of FIG. 4 in the four cycle mode is also illustrated for two entire rotations of the crankshaft, since, as is well known, two such rotations are required to illustrate the four cycle mode. The valves are opened and closed in the conventional manner, as illustrated in FIGS. 2B–2G.

Figure 3:
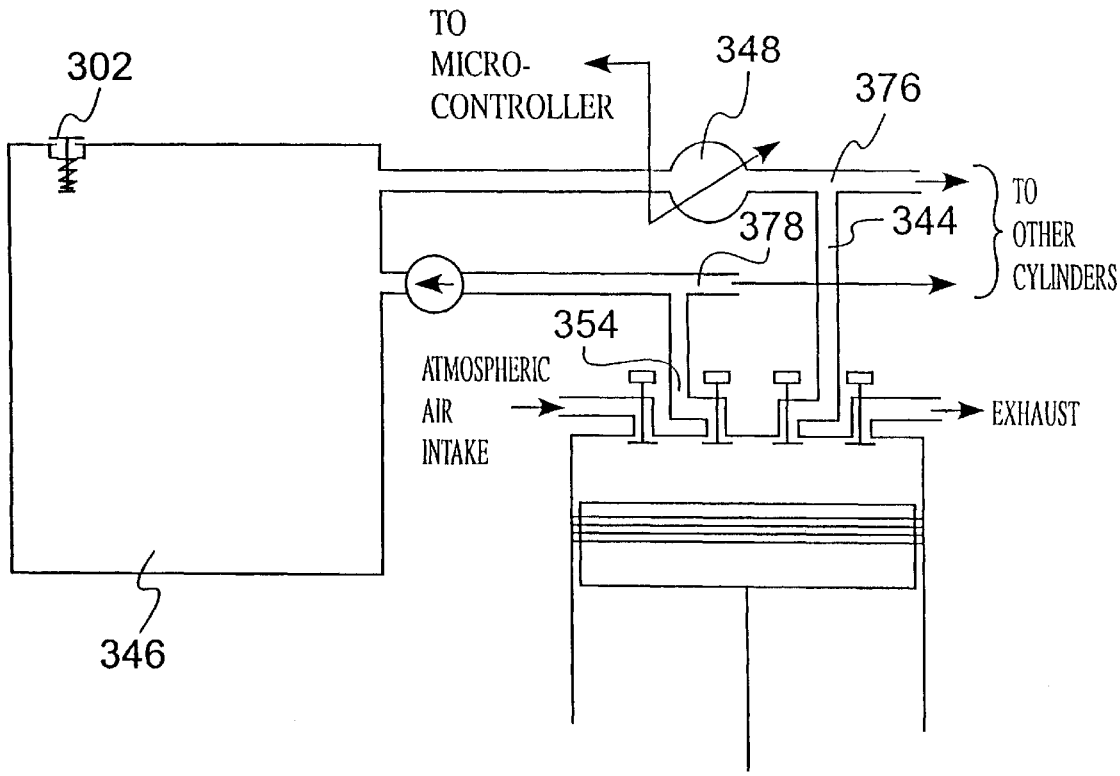
FIG. 3 is a diagrammatic view of an alternative embodiment of the invention.

FIGS. 3–6 illustrate additional and alternative structures in the present invention. FIG. 3 illustrates the air tank 346 having a pressure relief valve 302. Because the preferred engine has a plurality of expansible chamber devices coupled together, manifolding should be provided to interconnect ports of the same type. FIG. 3 illustrates the air tank inlet passage 344 as including an air tank inlet manifold 376 to which the air tank inlet ports of the other expansible chamber devices are connected. Similarly, the air tank outlet passage 354 includes an air tank outlet manifold 378, to which the air tank outlet ports of the other expansible chamber devices are connected. FIG. 3 also illustrates a variable pressure regulator 348, which is varied under control of the control system microcontroller. This permits the additional design parameter of controlling the pressure at which air from the air tank 346 is admitted into the expansible chambers.

FIG. 4 illustrates an alternative having an air tank outlet manifold 454 and an air tank inlet manifold 444, as illustrated in FIG. 3, but additionally having a pressure regulator 450 connected between those manifolds. Because one purpose of the compressed air is to supply combustion-supporting air into those expansible chamber devices which are operating as internal combustion engines and because during normal cruising air is being compressed in some of the expansible chamber devices while others are operating in the internal combustion mode, the path through regulator 450 permits air which has been compressed in some of the expansible chamber devices to be applied directly to support combustion in other expansible chamber devices in a manner which bypasses flow of that air through the tank 446. Thus, the flow path through regulator 450 permits combustion supporting air to flow directly from the air tank outlet manifold 454 into the air tank inlet manifold 444 through the regulator 450. The pressure of air supplied in that manner is controlled by the variable regulator 450, which is also connected to the microcontroller. Excess air beyond that required to support combustion is diverted through the check valve 458 into the air tank 446.

Figure 5:
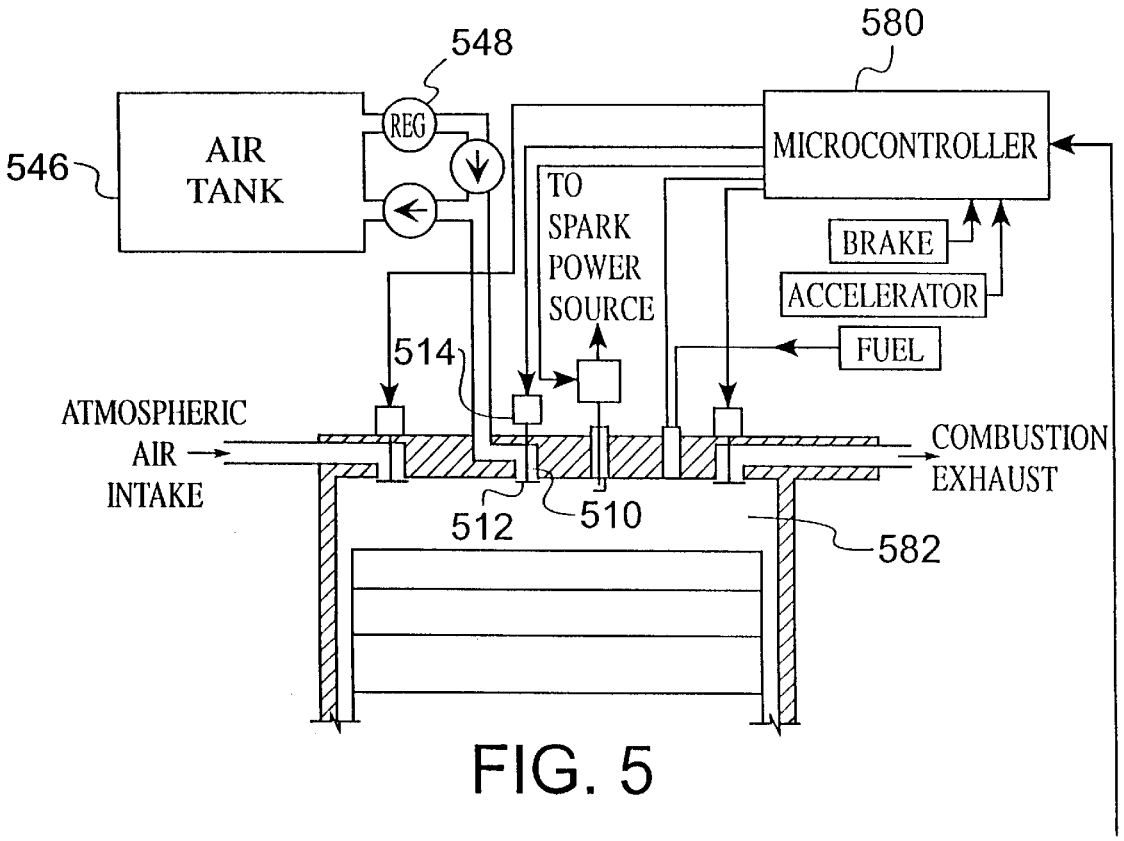
FIG. 5 is a diagrammatic view of an alternative embodiment of the invention.

FIG. 5 illustrates that, although four ports with control valves are preferred, it is possible to combine the air tank outlet and air tank inlet into a single tank port 510 controlled by a single valve 512 and a single valve controller 514. The valve 512 is operated by the microcontroller 580. When used for admitting air from the air tank 546 into the expansible chamber, the valve 512 is opened and closed at the same timing or phase intervals as the air tank inlet valve 50, illustrated in FIGS. 1 and 2. Similarly, when used for compressing air into the tank it is opened and closed at the same timing or phase intervals as the tank outlet valve 60. However, when operating in the pump/compressor mode, the valve 512 must only be opened late enough in the compression stroke that the pressure in the expansible chamber 582 exceeds the output pressure of the pressure regulator 548. If the valve 512 is opened at an earlier phase angle, during the upward compression stroke, air will pass out of the air tank 546 to the regulator 548 instead of being compressed and pumped into the air tank 546.

Figure 6:
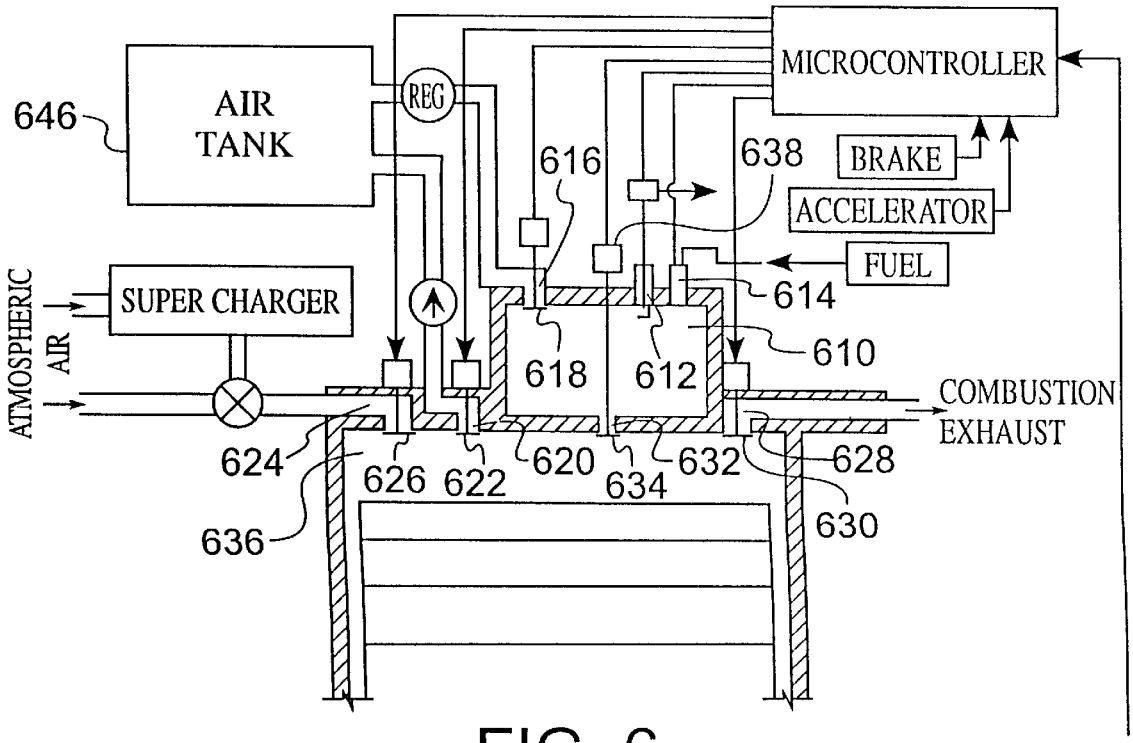
FIG. 6 is a diagrammatic view of an alternative embodiment of the invention.

FIG. 6 illustrates the application of a prior art concept to an embodiment of the present invention. The prior art concept is to introduce the fuel and the air into a separate chamber for mixing and combustion before opening that chamber into the cylinder. That concept is illustrated in U.S. Pat. No. 3,446,013. That chamber is, however, effectively a part of the expansible chamber of the expansible chamber device, although it is not always connected in communication with the cylinder chamber. FIG. 6 illustrates the separate fuel-air mixing and combustion chamber 610, having a spark source 612 and fuel inlet port 614. An air tank inlet port 616 is controlled by an air tank inlet valve 618. The embodiment of FIG. 6 also has an air tank outlet port 620 controlled by a valve 622, an atmospheric air inlet port 624 controlled by a valve 626 and a combustion gas exhaust port 628 controlled by a valve 630, similar to that illustrated in FIG. 1. The separate combustion chamber 610 also has a combustion chamber port 632, having a valve 634 to permit the combustion chamber port 632 to be opened into communication with the cylinder chamber 636. The valve 634 is controlled by a valve controller 638.

With the embodiment of FIG. 6, the fuel and air mixture proportions may be more closely controlled, mixing of the fuel and air may be done sufficiently earlier in the cycle to provide more homogeneous mixture of the fuel and air and the valve 634 may be controllably opened for a time interval which has both an angular position and a time of remaining open which are entirely under the control of the microcontroller.

A variety of other alternatives are also possible. For example, it is known to those skilled in the art that it is not necessary that fuel be injected directly into the cylinder. Fuel may instead be injected into the air inlet passage upstream of the port opening into the cylinder. This and the above alternative embodiments illustrate that there can be one or multiple manifolds connected to each expansible chamber and the valves can be in the manifold or directly at the cylinder chamber. However, for all the embodiments, these manifolds, separate combustion chambers or other passages and chambers are all functionally a part of the expansible chamber of the expansible chamber device. The expansible chamber is not necessarily limited to the cylinder chamber, but includes chambers in communication with the cylinder chamber. It is possible at one extreme to have a single port opening into the cylinder chamber with all of the other valving being connected through other chambers and manifolds to that single port. These other chambers and passages are simply a part of the total expansible chamber. Consequently, it should be apparent that there are many variations and alternatives, methods and concepts which can be adapted from the prior art but are applicable to the present invention.

From the above description it can be seen that the present invention permits the operating mode for each expansible chamber device to be independently selected to give the most efficient combination of operating modes for the instantaneously present operating conditions and also permits the modes to be switched as operating conditions change. Not only can the combination of modes for the coupled expansible chamber devices be changed, but pulse timing and pulse width for operating the valves, fuel injection and ignition can be varied in both timing and pulse width. The angular position of valve opening and the angular position of valve closing are controllably variable. High performance can be obtained by controlling these parameters and operating all of the expansible chamber devices in a two cycle IC mode and does not require overstressing the engine for a short interval of time in order to attain high performance and power.

It should also be apparent that an engine embodying the principles of the present invention can have several expansible chamber devices operating in the manner described above, but can additionally be provided with expansible chamber devices which are coupled to them and operate in the conventional manner without the capability of changing modes.

Figure 7:
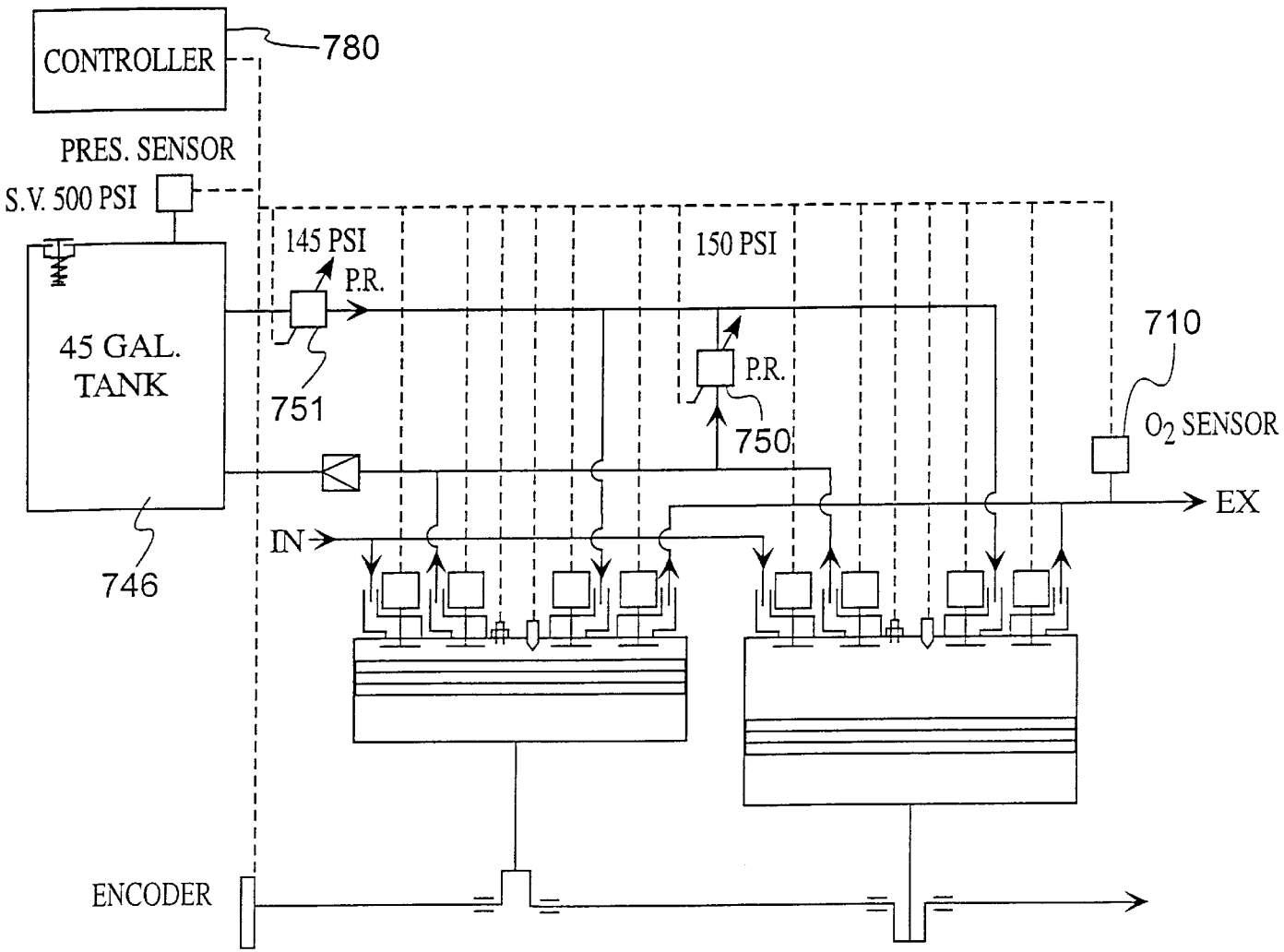
FIG. 7 is a diagrammatic view illustrating two pistons of an embodiment of the invention.

The preferred embodiment of the invention has too many structures to permit all of the preferred structures to be shown in one view and therefore the components of the preferred embodiment are shown in multiple views. FIG. 7 illustrates two expansible chamber devices coupled together. However, it is currently preferred that there be four, although there can be more or fewer. FIG. 7 also illustrates an oxygen sensor 710, which is connected to the microcontroller 780 and used by the microcontroller in the manner which is known in the prior art. FIG. 7 also illustrates that the preferred by-pass pressure regulator 750 operates at an output pressure of 150 psi, the air tank inlet pressure regulator 751 operates with an output pressure of 145 psi and that the preferred air tank 746 is a 45-gallon tank, having a maximum air pressure of 500 psi. This size is designed to permit the vehicle to be propelled entirely by using the air in the tank in the two cycle mode for at least 20 to 30 seconds with maximum power. Higher pressures may be used and can be attained by increasing the compression ratio, as described above.

While certain preferred embodiments of the present invention have been disclosed in detail, it is to be understood that various modifications may be adopted without departing from the spirit of the invention or scope of the following claims.

What is claimed is:

1. A improved hybrid, expansible chamber engine system including a fuel source; an ignition source; an air tank for storing pressurized air; at least one expansible chamber device having a movable component drivingly linked to a common mechanical power output, each expansible chamber device having ports opening into its chamber including an atmospheric air intake port connected through an atmospheric air intake passage to a source of atmospheric air, an air tank outlet port connected through an air tank outlet passage to the air tank for, at times, supplying compressed air to the air tank; a controllable valve at each of said ports for controlling the flow of gas through the port; and a control system including an input connected to a position sensor linked to the mechanical power output for inputting the instantaneous position of the power output and including outputs connected to the valves for independently operating each expansible chamber device alternatively in a mode selected from the modes of internal combustion engine, air motor, and air compressor, wherein the improvement comprises:

a supercharger connected between a source of atmospheric air at atmospheric pressure and the atmospheric air intake port and controllably connected to the control system, the supercharger being actuated by the control system for delivering supercharged air to the chamber when the expansible chamber device is operating in the compressor mode.

2. An engine in accordance with claim 1 and further comprising an air tank inlet port connected through a pressure regulator to said air tank for admitting a controllable quantity of air from said tank into the chamber at a regulator output pressure which is less than the air tank pressure.

3. An improved method for compressing air in a hybrid, expansible chamber engine system including a fuel source; an ignition source; an air tank for storing pressurized air; at least one expansible chamber device having a piston drivingly linked to a common mechanical power output, each expansible chamber device having ports opening into its chamber including an atmospheric air intake port connected through an atmospheric air intake passage to a source of atmospheric air, an air tank outlet port connected through an air tank outlet passage to the air tank for, at times, supplying compressed air to the air tank; a controllable valve at each of said ports for controlling the flow of gas through the port; and a control system including an input connected to a position sensor linked to the mechanical power output for inputting the instantaneous position of the power output and including outputs connected to the valves for independently operating each expansible chamber device alternatively in a mode selected from the modes of internal, combustion engine, air motor, and air compressor, the improvement comprising:

supercharging the atmospheric air supplied to the air intake passage while simultaneously supplying air to the air tank through the air tank outlet port by compression in the expansible chamber device operating in the air compressor mode.

4. An improved method for two cycle operation of a hybrid, expansible chamber engine system including a fuel source; an ignition source; an air tank for storing pressurized air; at least one expansible chamber device having a piston drivingly linked to a common mechanical power output, each expansible chamber device having ports opening into its chamber including an atmospheric air intake port connected through an atmospheric air intake passage to a source of atmospheric air, a tank air intake port connected through a tank air intake passage to said air tank, an air tank outlet port connected through an air tank outlet passage to the air tank for, at times, supplying compressed air to the air tank; a controllable valve at each of said ports for controlling the flow of gas through the port; and a control system including an input connected to a position sensor linked to the mechanical power output for inputting the instantaneous position of the power output and including outputs connected to the valves for independently operating each expansible chamber device alternatively in a mode selected from the modes of internal combustion engine, air motor, and air compressor, the improvement comprising:

opening the air tank inlet port valve near zero degrees in the engine cycle to provide combustion supporting air into the chamber and maintaining the air tank inlet port valve open for a length of time which an increasing function of the quantity of air to be admitted into the chamber.

5. In a hybrid, expansible chamber engine system including a fuel source; an ignition source; an air tank for storing pressurized air; at least one expansible chamber device having a piston drivingly linked to a common mechanical power output, each expansible chamber device having ports opening into its chamber including an atmospheric air intake port connected through an atmospheric air intake passage to a source of atmospheric air, an air tank outlet port connected through an air tank outlet passage to the air tank for, at times, supplying compressed air to the air tank; a controllable valve at each of said ports for controlling the flow of gas through the port; and a control system including an input connected to a position sensor linked to the mechanical power output for inputting the instantaneous position of the power output and including outputs connected to the valves for independently operating each expansible chamber device alternatively in a mode selected from the modes of internal combustion engine, air motor, and air compressor, an improved method for increasing the pressure at which air is pumped to the air tank, the improvement comprising:

(a) reducing the top dead center clearance at the top of the piston to increase the compression ratio; and (b) increasing the pressure of the compressed air supplied to the air tank by controllably opening the valve at the air tank outlet port at a later phase angle in the engine cycle.

6. A method in accordance with claim 5, wherein the method further comprises: supercharging the atmospheric air supplied to the air in take passage while simultaneously supplying air to the air tank through the air tank outlet port by the expansible chamber device operating in the air compressor mode.

7. The method in accordance with claim 6 and further comprising opening the air tank inlet port valve near zero degrees in the engine cycle to provide combustion supporting air into the chamber and maintaining the air tank inlet port valve open for a length of time which an increasing function of the quantity of air to be admitted into the chamber.

* * * * *